US005816270A

United States Patent [19]

Nadel

[11] Patent Number: 5,816,270

[45] Date of Patent: Oct. 6, 1998

[54] CO-MOLDED MAKEUP APPLICATOR ASSEMBLY

[75] Inventor: Murray Nadel, New Rochelle, N.Y.

[73] Assignee: Nadel Industries, Port Chester, N.Y.

[21] Appl. No.: 604,737

[22] Filed: Feb. 21, 1996

[51] Int. Cl.[6] ..... A45D 40/26

[52] U.S. Cl. ..... 132/320; 15/143.1; 132/148

[58] Field of Search ..... 132/320, 317, 132/318, 148, 218; 15/143.1, 222

[56] References Cited

U.S. PATENT DOCUMENTS

| | | | |
|---|---|---|---|
| D. 116,216 | 8/1939 | Brekke | 132/73 |
| D. 293,034 | 12/1987 | duCret . | |
| D. 342,583 | 12/1993 | King . | |
| 2,099,030 | 11/1937 | Morrison | 132/320 |
| 2,442,503 | 6/1948 | Melnikoff | 132/320 |
| 3,033,213 | 5/1962 | Joss et al. | 132/218 |
| 3,071,143 | 1/1963 | Bau | 132/148 |
| 3,591,885 | 7/1971 | Fritzen, Jr. | 15/143.1 |
| 3,613,697 | 10/1971 | Andrews | 132/317 |
| 4,748,990 | 6/1988 | Brown et al. . | |
| 4,860,815 | 8/1989 | Parker et al. . | |
| 4,913,682 | 4/1990 | Shabo . | |
| 5,093,053 | 3/1992 | Eckardt et al. . | |
| 5,094,254 | 3/1992 | Krueckel et al. | 132/218 |
| 5,116,557 | 5/1992 | Debaes et al. . | |
| 5,176,754 | 1/1993 | Hirzel | 132/320 |
| 5,205,301 | 4/1993 | Nakamura | 132/320 |
| 5,247,951 | 9/1993 | Machida et al. . | |
| 5,533,537 | 7/1996 | Mourad | 132/148 |

FOREIGN PATENT DOCUMENTS

| | | | |
|---|---|---|---|
| 1346451 | 11/1963 | France | 132/218 |
| 2155774 | 10/1985 | United Kingdom | 132/320 |

*Primary Examiner*—Todd E. Manahan
*Attorney, Agent, or Firm*—Amster Rothstein & Ebenstein

[57] ABSTRACT

A co-molded makeup applicator assembly includes a resilient body and a rigid handle cover. The generally elongated and unitarily molded body is formed of a resilient material. The body has a first end and a second end, at least one of the first and second ends defining an applicator for applying makeup. The handle cover is co-molded over a portion of the body and is formed of generally rigid material. The handle cover cooperates with the body to form an integral handle and applicator assembly.

8 Claims, 3 Drawing Sheets

CO-MOLDED MAKEUP APPLICATOR ASSEMBLY

BACKGROUND OF THE INVENTION

The present invention relates generally to applicators for applying makeup to the face and for removing deposits therefrom, and more specifically, to makeup applicators formed by co-molding a unitary body and applicator from a resilient material and a generally rigid material over a portion of the body.

The use of makeup applicators for applying and removing makeup is well known in the art. Typical makeup applicators are constructed with a relatively rigid handle and a resilient applicator. To apply makeup, the user dips or wipes the applicator into the cosmetics, and manipulates the handle to position the applicator with respect to the application area. The shape of the applicator is adapted to best perform the desired function (e.g., applying pressed powder for the eyes or face, liquid or solid lipstick, eyeliner, mascara blush and the like).

In certain prior art makeup applicators, the handle is fabricated from plastic, and a foam applicator pad is attached to the handle by swaging a metal sleeve over one end of the handle and the pad. This arrangement is disadvantageous as it can be relatively expensive to manufacture, usually involving several steps in the fabrication process. In addition, the resulting assembly is neither particularly damage tolerant nor aesthetically appealing.

Another prior art makeup applicator is shown in U.S. Pat. No. 4,913,682 to Shabo ("Shabo"). The Shabo applicator includes a handle formed with an elongated peg on which is disposed a foam swab for applying makeup.

It is also known in the prior art to manufacture composite thermoplastic structures by co-molding different materials in a single mold. An example is taught in U.S. Pat. No. 5,093,053 to Eckhardt et al ("Eckhardt"). The Eckhardt patent discloses a method for manufacturing multiple-layer molded articles by first introducing a first thermoplastic material along the walls of an injection molding machine, subsequently injecting a second (foaming) thermoplastic material with a chemical or physical expanding agent, and then forcing gas into the mold cavity to evenly distribute the second thermoplastic material in the mold cavity. Another teaching of co-molding is described in U.S. Pat. No. 5,116,557 to Debaes et al. ("Debaes"). The Debaes reference discloses a method of fabricating objects having an elastomeric outer wall and a synthetic foam core. In that method, a micro-cellular or non-cellular elastomer is applied to a surface(s) that defines some or all of the mold cavity in a first step, and before the elastomer is completely cured, a second reaction mixture for obtaining a synthetic foam is injected into the mold cavity. The entire part is then cured and removed from the mold.

The present invention overcomes the shortcomings associated with prior art makeup applicators by providing a co-molded applicator assembly that is aesthetically and functionally superior to those in the prior art, yet with lower manufacturing costs, enhanced durability and superior reliability.

SUMMARY OF THE INVENTION

In accordance with the present invention, it is an object thereof to provide a co-molded makeup applicator assembly comprised of an integral applicator handle and body assembly.

It is a further object of the present invention to provide a co-molded makeup applicator assembly having a first applicator disposed at one end of the body and a second applicator disposed at an opposite end of the body, where the first and second applicators are unitarily molded.

It is still another object of the present invention to provide a co-molded makeup applicator assembly having an applicator disposed at one end of the body and a comb disposed at an opposite end of the body, where the applicator and comb are unitarily molded.

It is yet another object of the present invention to provide a co-molded makeup applicator assembly having enhanced durability, functionality and aesthetics, and lower manufacturing costs.

It is still another object of the invention to provide a singularly molded makeup applicator and handle assembly that is constructed and arranged in accordance with the foregoing objects, but where the handle is unitarily formed with the body.

In accordance with the above objects and additional objects which will become apparent hereinafter, the present invention provides a co-molded makeup applicator assembly, comprising: a generally elongated and unitarily molded body formed of a resilient material, the body having a first end and a second end, where at least one of the first end and the second end of the body defines an applicator for applying makeup; and a handle cover co-molded over a portion of the body, the handle cover comprising a generally rigid material which cooperates with the body to form an integral handle and applicator assembly.

In a preferred embodiment, the body is molded from a resilient material such as elastomers, plastomers, thermoplastic elastomers, thermoplastic rubber, thermoplastic olefins and the like. The resilient characteristics enable the applied makeup to be easily spread, and permit precise control over the application to be maintained. Furthermore, these materials provide superior resistance to environmental stress cracking, high flexibility, low moisture absorption and light weight. In another embodiment of the invention, the body and unitary applicator may be constructed from a thermoplastic or like foam material.

A handle is formed by co-molding a handle cover over a portion of the body. The handle cover is preferably comprised of a rigid thermoplastic (such as polystyrene) or other thermoplastic material. The handle cover imparts longitudinal stiffness to the integral handle/body assembly and offers excellent toughness and warp resistance. To facilitate grasping thereof, the body may be formed with a plurality of axially elongated protrusions extending from the molded surface thereof, and the handle cover may be formed around the body such that the axially elongated protrusions of resilient body material extend therethrough. In an alternative embodiment, the handle is unitarily molded as part of the body from the same material.

The invention provides for the use of many different applicator configurations. In one embodiment, the body may be formed with applicators disposed at each end thereof. In an exemplary implementation, the applicator at one end is adapted for applying liquid lipstick, and the applicator at the opposite end is constructed and arranged to function as a line softener, product spreader and the like. A liquid lipstick applicator in an illustrative embodiment comprises a first applicator face, a pointed tip, and at least one other applicator face. The first applicator face defines a plurality of surface undulations to facilitate picking up and applying makeup. The body defines a central axis extending in at least one direction of elongation thereof, and the first applicator face is disposed at an angle relative to the central axis. The applicator further comprises a second applicator face disposed at an angle relative to the central axis and defining a smooth applicator surface. In another embodiment, the applicator at one end of the body may be adapted for applying eyeliner, and the body at the opposite end thereof may incorporate an integral brow comb or other accessory. Many shapes and configurations for the applicators may be used in accordance with the present invention and others will become apparent to persons skilled in the art as the detailed description of the invention proceeds with particular reference to the accompanying drawings.

DETAILED DESCRIPTION OF THE PREFERRED EMBODIMENTS

With reference to the several views of the drawings, there are depicted several embodiments of co-molded makeup applicator assemblies in accordance with the present invention.

Figure 1:
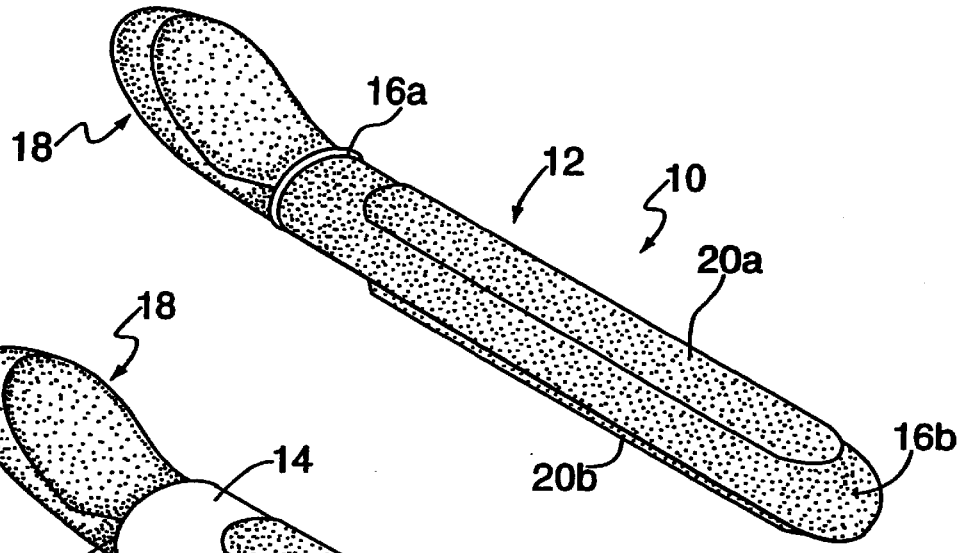
FIG. 1 is an isometric view of an applicator body in a first embodiment with an integral applicator head.
Figure 2:
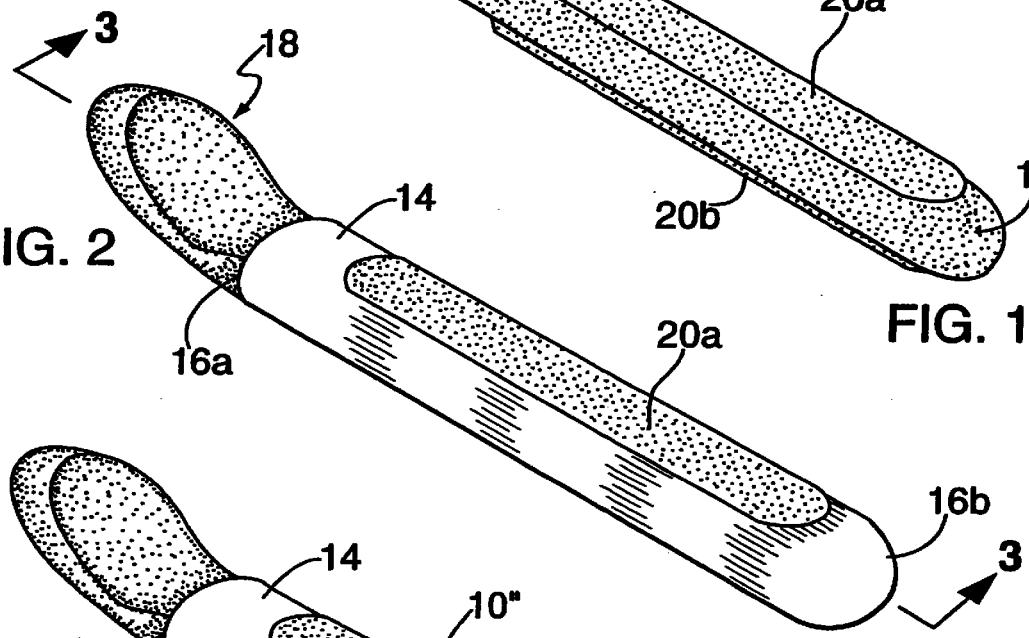
FIG. 2 is an isometric view of the final applicator assembly in the first embodiment with the handle cover molded over the body.
Figure 3:
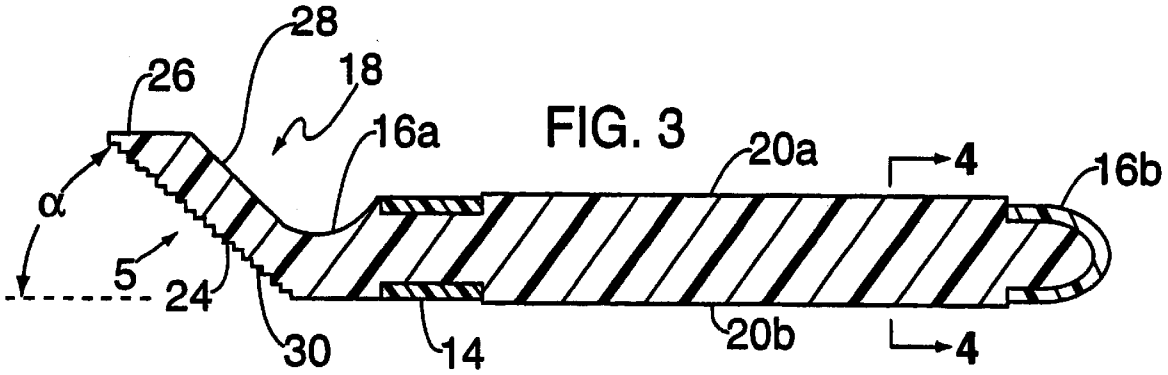
FIG. 3 is a sectional view thereof taken along lines 3—3 in FIG. 2.
Figure 4:
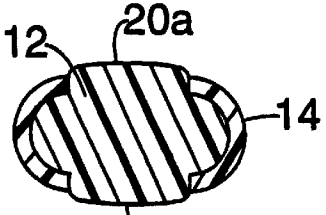
FIG. 4 is a sectional view thereof taken along lines 4—4 in FIG. 3.
Figure 5:
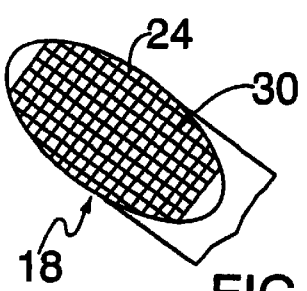
FIG. 5 is a plan view of an applicator face.

Referring now to FIGS. 1–6, in a first embodiment, a makeup applicator assembly 10 is generally comprised of a longitudinally elongated and unitarily molded body 12, and a handle cover 14 co-molded over a portion of the body 12. The body 12 has a first end 16*a* and a second end 16*b*, where the first end 16*a* includes an integral applicator 18 as shown. The body 12 is preferably molded from a resilient material selected from, among others, the group of elastomers, plastomers, thermoplastic elastomers, thermoplastic rubber and the like. The resilient characteristics of the body 12 and applicator 18 facilitate the application and removal of makeup as described above. In an illustrative implementation, the body is formed of a polyolefin elastomer such as ENGAGE® EP8500 available from DOW PLASTICS, having a Shore A hardness of about 75 in accordance with ASTM D-2240. An exemplary thermoplastic rubber material such as SANTOPRENE® available from ADVANCED ELASTOMER SYSTEMS, has a Shore A hardness of approximately 45. Alternatively, the body 12 may be molded from a foam material by using an open or closed cell foam in the course of the injection process. In the illustrative embodiment, the body 12 has an oval cross section and is molded with a pair of axially elongated and opposed raised portions 20*a*, 20*b*, that extend outwardly from the oval section thereof as shown in FIGS. 1 and 4. When the handle cover 14 is co-molded over the body as depicted in FIGS. 2, 3 and 4, the raised portions 20*a*, 20*b* project a nominal distance above the longitudinally elongated outer surface 22 of the body 12. This construction facilitates easy grasping the applicator assembly 10 for optimum control when applying makeup.

The handle cover 14 is co-molded over the body 12 (i.e., it forms a "core" for the handle) in a two-part rotational and transfer injection mold (not shown) of the type known in the art. The molding process in the exemplary embodiment is implemented by injecting the body 12, rotating the fully cured or partially cured body 12 into a female handle cavity, and then injecting the handle material around the body 12. These materials are either cured independently (i.e., the body fully cures and then the handle material is injected) or the handle material is injected while the body material is uncured or partially cured. If required, a suitable gas and/or blowing/expanding agent is introduced into the mold cavity in accordance with well-known co-molding techniques. In the preferred embodiment, the handle cover is molded from a thermoplastic material (e.g., Polyethylene, Polystyrene, Polypropylene, ABS, SAN and the like). Alternatively, the handle cover 14 may be fabricated with a thermoset material (i.e., after cure, it cannot be elastically deformed into another permanent shape). The rigidity of the handle cover 14 enables a resilient material to be used for the body 12, while still providing an applicator assembly 10 with excellent durability, damage tolerance and lightweight overall construction. A representative handle cover constructed with Polyethylene has a flexural modulus of approximately 94,000 psi and a tensile yield strength of approximately 3,500 psi.

Figure 6:
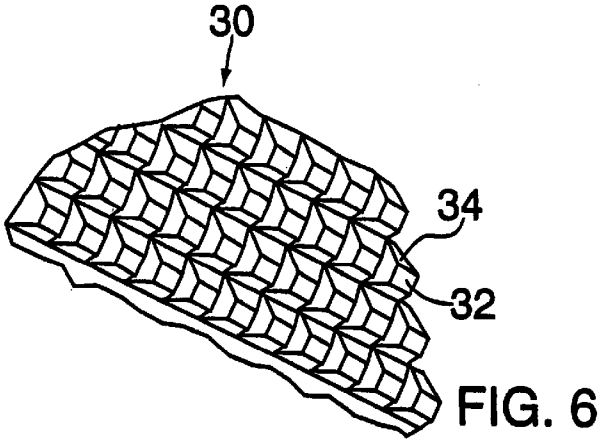
FIG. 6 is a detail view of the applicator face shown in FIG. 5.

Referring to FIGS. 1, 2, 3 and 5, the illustrative applicator 18 is defined by an applicator face 24, pointed tip 26, and another applicator face 28. As best seen in FIG. 3, the applicator face 24 is disposed at an acute angle $\alpha$ relative to a central longitudinal axis of the body 12. More specifically, in the applicator 18 of the preferred embodiment, the applicator face 24 includes a plurality of surface undulations 30 to facilitate picking up and applying makeup. FIG. 6 shows the surface undulations 30 in greater detail, where each surface undulation has a semi-pyramidal configuration defined by a flat top 32, and four (4) sloping sides 34 that are disposed at acute angles towards each other relative to a plane parallel to the longitudinal extent of the applicator face 24. Although this configuration demonstrates excellent makeup retention, it is anticipated that obvious modifications to this surface arrangement will be implemented by persons skilled in the art.

Figure 7:
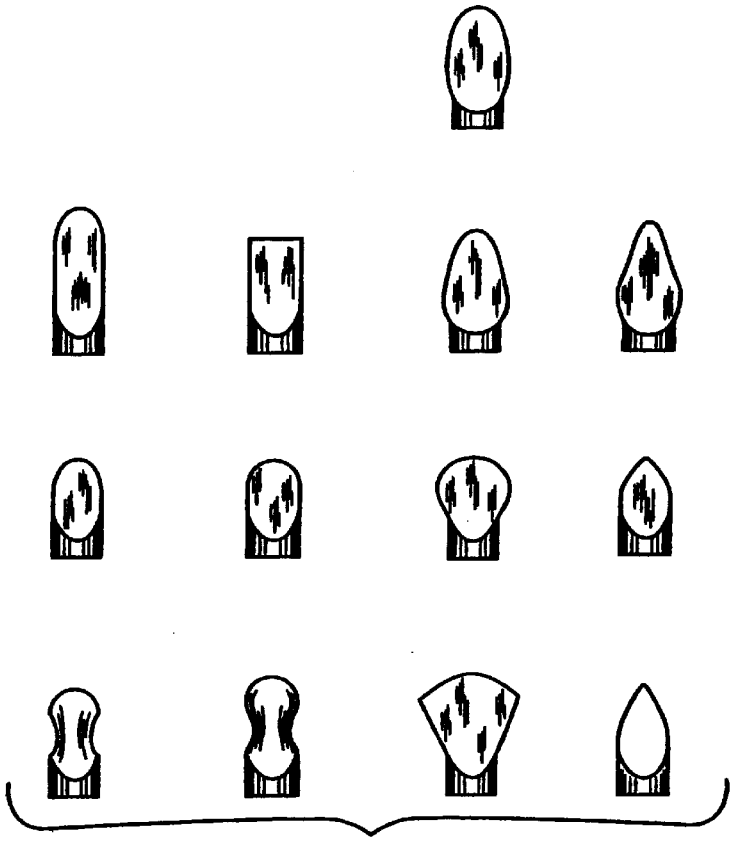
FIG. 7 is a bottom view of a plurality of applicator configurations.
Figure 8:
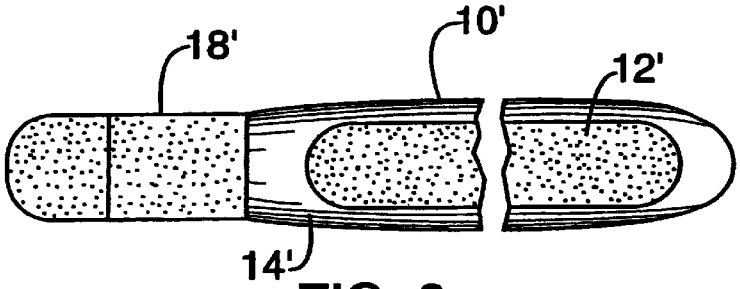
FIG. 8 is a top plan view of an applicator assembly in a second embodiment.
Figure 9:
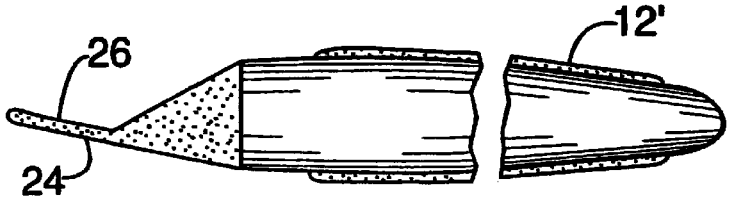
FIG. 9 is a side elevational view of the applicator assembly depicted in FIG. 8.

Referring now to FIG. 7, a plurality of alternative applicator shapes identified by the reference numeral 18' are shown. FIGS. 8 and 9 depict an alternative applicator assembly 10', with a different body 12' configuration and applicator 18' arrangement. In the embodiment of FIGS. 8 and 9, the applicator 18' includes a flat applicator face 24 and opposed flat applicator face 26 which collectively define a nominal applicator thickness.

Figure 10:
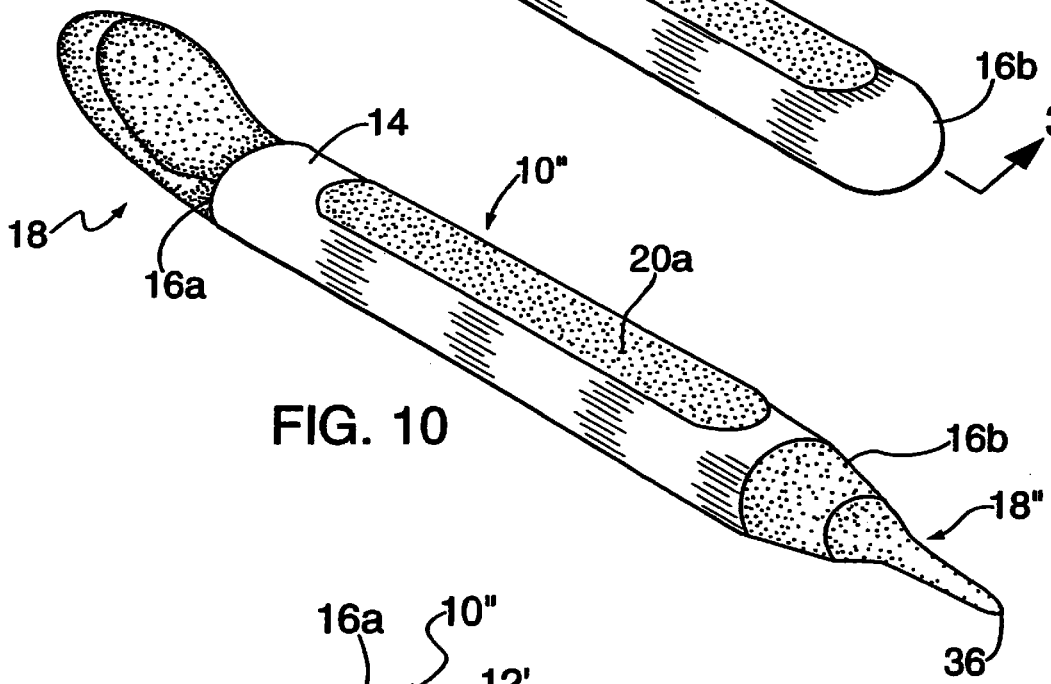
FIG. 10 is an isometric view of an applicator assembly in another embodiment with a pair of applicator heads disposed at opposite ends thereof.
Figure 11:
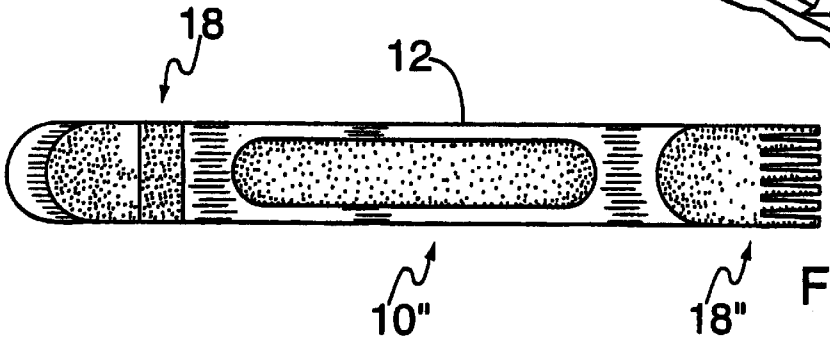
FIG. 11 is a top plan view of another dual applicator head assembly.

Referring now to FIG. 11, there is depicted another alternative embodiment of the applicator assembly 10", which includes a pair of applicators 18 and 18", respectively disposed at the opposed first and second ends, 16*a* and 16*b*, of the body 12. In that embodiment, the second applicator 18" is configured as a brow comb. FIG. 10 depicts an applicator assembly 10' having a first applicator 18 at the first end 16*a* thereof as described above, and a tapered applicator 18" constructed and arranged with a tapered point 36 to facilitate the application of eye liner. It will be appreciated by persons skilled in the art, that an applicator assembly in accordance with the present invention may be molded with many different shapes and configurations and that the exemplary configurations disclosed herein may be readily modified.

Figure 12:
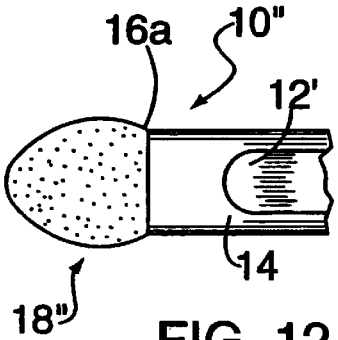
FIG. 12 is a partial top plan view of yet another embodiment of the invention with a foam body and applicator head.

Referring now to FIG. 12, yet another embodiment of an applicator assembly 10" includes a foam body 12' having an integral foam applicator 18'". The method of fabrication may include molding the handle cover 14 first and then injecting a quantity of foaming material with an expanding agent, and curing the same to form a co-molded assembly 10". There are many ways to perform such a molding operation as is well known in the prior art relating to molding multiple layer thermoplastic products. Although only the first end 16*a* is shown, this embodiment may be arranged with a second applicator 18 (foam) disposed at the second end 16*b* thereof as described above and depicted in FIGS. 10 and 11.

The present invention has been shown and described in what are considered to be the most practical and preferred embodiments. It is anticipated, however, that departures may be made therefrom and that obvious modifications will be implemented by persons skilled in the art.

We claim:

1. A co-molded makeup applicator assembly, comprising:

a generally elongated and unitarily molded body formed of a resilient material, said body having a first end and a second end, at least one of said first end and said second end of said body defining an applicator for applying makeup; and a handle cover co-molded over a portion of said body, said handle cover being formed of a generally rigid material and cooperating with said body to form an integral handle and applicator assembly, said handle cover defining at least one longitudinally extending slot through which a portion of said body extends to facilitate non-slip grasping of said assembly by a user.

2. The co-molded makeup applicator assembly recited in claim 1, wherein at least one of said first end and said second end of said body defines at least one of a line softener, product spreader, eyeliner and comb.

3. The co-molded makeup applicator assembly recited in claim 1, wherein said body is molded from at least one of elastomers, plastomers, thermoplastic elastomers, thermoplastic rubber, and thermoplastic olefins.

4. The co-molded makeup applicator assembly recited in claim 3, wherein said handle cover is molded from at least one thermoplastic material.

5. The co-molded makeup applicator assembly recited in claim 1, wherein said body is molded from a foam material.

6. The co-molded makeup applicator assembly recited in claim 1, wherein said applicator comprises a first applicator face, a pointed tip and at least one other applicator face.

7. The co-molded makeup applicator assembly recited in claim 6, wherein said first applicator face defines a plurality of surface undulations to facilitate picking up and applying makeup.

8. The co-molded makeup applicator assembly recited in claim 6, wherein said body defines a central axis extending in at least one direction of elongation thereof, and said first applicator face is disposed at an angle relative to said central axis, said applicator further comprising a second applicator face disposed at an angle relative to said central axis and defining a smooth applicator surface.

* * * * *